US008712288B2

(12) United States Patent
Yasumoto

(10) Patent No.: US 8,712,288 B2
(45) Date of Patent: Apr. 29, 2014

(54) IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 177 days.

(21) Appl. No.: 13/283,315

(22) Filed: Oct. 27, 2011

(65) Prior Publication Data

US 2012/0114351 A1 May 10, 2012

(30) Foreign Application Priority Data

Nov. 5, 2010 (JP) ..... 2010-248981

(51) Int. Cl.
*G03G 15/08* (2006.01)

(52) U.S. Cl.
USPC ..... 399/121

(58) Field of Classification Search
USPC ..... 399/66, 121, 301, 302, 308
See application file for complete search history.

(56) References Cited

U.S. PATENT DOCUMENTS 8,126,365 B2 * 2/2012 Nishida et al. ..... 399/165
2009/0317108 A1 * 12/2009 Taki et al. ..... 399/66

FOREIGN PATENT DOCUMENTS

JP 9-16944 A 1/1997
JP 2007-11107 A 1/2007

* cited by examiner

*Primary Examiner* — David Gray
*Assistant Examiner* — Gregory H Curran
(74) *Attorney, Agent, or Firm* — Canon USA Inc IP Division

(57) ABSTRACT

An image forming apparatus includes an intermediate transfer belt unit and a transfer belt unit each of which has a deviation control mechanism and which are held in contact with each other at a transfer portion, wherein at least a steering roller on which a secondary transfer belt is suspended is situated such that a traction surface thereof does not constitute a transfer surface including a transfer roller.

3 Claims, 18 Drawing Sheets

IMAGE FORMING APPARATUS

BACKGROUND OF THE INVENTION

1. Field of the Invention

The present invention relates to an image forming apparatus such as a copying machine, a printer, or a printing machine. In particular, the present invention relates to an image forming apparatus in which an image bearing belt such as an intermediate transfer belt, and a transfer belt such as a secondary transfer belt, are driven while exhibiting contact portions being in contact with each other.

2. Description of the Related Art

In connection with an image forming apparatus employing an intermediate transfer belt bearing a toner image, there exists a configuration which adopts a transfer belt configured to bear and convey a recording material in order to achieve an improvement in terms of conveyance property for the recording material, which can be of various types (Japanese Patent Application Laid-Open No. 2007-11107).

The above-described intermediate transfer belt and transfer belt, which are endless belts, are driven while suspended between a plurality of rollers including a driving roller. Depending upon the outer diameter precision of the rollers and the alignment precision between the rollers, such belts involve an issue referred to as belt deviation, in which the belts are deviated toward one edge direction during running.

As a method of solving the issue of belt deviation, Japanese Patent Application Laid-Open No. 9-16944 discusses a deviation control method using a steering roller. According to the method, one of stretching rollers is used as a steering roller which is supported so as to be capable of freely changing axial alignment, and controlled by an actuator such as a motor. FIG. 15 is a control diagram illustrating this method, and according to a deviation E of an actual measurement value PV of the edge position obtained by an edge detection sensor from a target position SV of an endless belt edge, a control controller inputs a predetermined command value MV to a motor driver to drive the steering motor. Accordingly, the axial alignment of the steering roller is changed, resulting in a change in the edge position of the endless belt to effect a feedback control.

However, in the method discussed in Japanese Patent Application No. 9-16944, when the suspension orientation of the belt is changed, the belt conveyance direction is also changed.

FIG. 11 illustrates a generally adopted suspension layout for a belt 114. In this example, the belt is suspended on four rollers. In the drawing, a steering roller 113 is shaded; for the sake of convenience in illustration, the other rollers will be referred to as suspension rollers 111 and 112 and a driving roller 110. The belt 114 is formed of a material exhibiting high Young's modulus, and its expansion/contraction is substantially negligible. When the three rollers other than the steering roller 113 are fixed in position, the layout range for the steering roller 113 is restricted to a range satisfying the condition in which the sum total of L1 and L2 in FIG. 11 is fixed (L1+L2=constant); in other words, it is restricted to an elliptical path C whose focuses are the suspension rollers 111 and 112.

FIG. 12 illustrates the case where deviation control is effected, in this case, the steering roller 113 tries to change the axial alignment in the direction of an arrow S in the drawing by an actuator (not illustrated). FIG. 12 is a sectional view of the suspension layout, thus, specifically, the steering roller 113 tries to effect a change in suspension orientation to an inclination such that the front end thereof comes to a position 113F and that the rear end thereof comes to a position 113R.

In reality, however, due to the restraint to the above-described elliptical path C, the front and rear ends of the steering rollers are respectively corrected to positions 113F' and 113R'. The steering roller 113 also serves as a tension roller applying a desired tension to the endless belt 114 by an urging unit 120 such as a spring, and correction is effected through the expanding/contracting action of the urging unit 120. The change in axial alignment resulting from this correction is the change in the belt conveyance direction.

FIGS. 13 and 14 illustrates the suspension layout (FIG. 12) as seen from above, and illustrate a traction surface pulled by the steering roller 113. Here, the traction surface is a belt surface suspended between the steering roller and the suspension roller such that the steering roller is situated on the downstream side in the belt moving direction. The endless belt 114 is driven in the direction of an arrow V in the drawings; the solid line indicates the suspension orientation at time t, and the dashed line indicates the suspension orientation at time t+Δt. The edge position of the belt 114 is measured at two measurement points M1 and M2 in the conveyance direction (the conveyance speed is one effecting movement through a distance corresponding to the distance between the points M1 and M2 during the time Δt.) In FIG. 13, it is assumed that the steering roller 113 is inclined in the direction S (See FIG. 12), and the belt 114 is conveyed in the X-direction in a suspension orientation at an inclination angle γ. At this time, it is thought that the edge position is displaced in the Y-direction at the measurement points M1 and M2, that is, belt deviation is generated. However, tracing of a mass point Pt, which is an arbitrary point on the traction surface at the time t, shows that, at the time t+Δt, the mass point Pt is situated at the position Pt+Δt to be attained through advancing straight ahead in the X-direction, which means the mass point itself has made no displacement in the Y-direction.

In reality, however, the steering roller 113 is inclined in the direction S, and is corrected to the elliptical path, so that, as illustrated in FIG. 14, there are generated two changes: the suspension orientation of the inclination γ and the conveyance direction of the inclination β. Thus, between the time t and the time t+Δt, there are generated not only in the displacement in the Y-direction at the measurement points M1 and M2, that is, the belt deviation, but also a displacement in the Y-direction of the mass point Pt itself. As can be seen, assuming that the mass point Pt is an image (dot) formed on the traction surface, positional deviation is generated in the main scanning direction (Y-direction) in FIG. 14, and, assuming that the measurement point M1 is an image forming portion of a first color and that the measurement point M2 is an image forming portion of a second color, the difference in positional deviation appears in the form of color misregistration.

As described above, on the traction surface side of the steering roller, there exists a mass point displacement in the thrust direction accompanying steering control. Generally speaking, in the case of a two-axis suspension configuration, the concept of an elliptical path is not applicable, so that the mass point displacement does not easily lead to a problem. However, in the case of the secondary transfer belt as discussed in Japanese Patent Application Laid-Open No. 2007-11107, in which there is a need for a difference in outer diameter, a two-axis suspension configuration may involve a similar problem.

More specifically, the smaller the diameter of a separation roller 181, the more improved is the separation performance; when the difference in outer diameter between the two axes is increased as illustrated in FIG. 18A, the large diameter side roller 180 becomes equivalent to two rollers 183 and 184 close to each other as illustrated in FIG. 18B. As a result, even in the case of a two-axis suspension configuration, when a secondary transfer roller is used, mass point displacement on the traction surface due to the steering roller constitutes a problem.

In the case of a configuration in which both the transfer belt and the intermediate transfer belt receive an external force in the thrust direction, adopting a configuration in which the traction surface of one belt is allowed to come into contact with another belt results in a disturbance in which the other belt receives an external force in the thrust direction, and in which steering control of the one belt causes deviation in the other belt.

SUMMARY OF THE INVENTION

The present invention is directed to an image forming apparatus including a suspension configuration in which deviation control operations respectively effected on belts held in contact with each other do not interfere with each other.

According to an aspect of the present invention, an image forming apparatus includes a first belt rotatable and configured to bear a toner image, an image forming unit configured to form a toner image on the first belt, a second belt rotatable and configured to bear and convey a recording material, a transfer unit configured to transfer the toner image formed on the first belt to the recording material borne by the second belt at a nip portion formed between the first belt and the second belt, a first steering roller configured to adjust a position of the first belt in a width direction orthogonal to a moving direction of the first belt by inclining an axis, a first suspension roller on which the first belt is suspended, a second steering roller configured to adjust a position of the second belt in a width direction orthogonal to a moving direction of the second belt by inclining an axis, and a second suspension roller on which the second belt is suspended, wherein the second steering roller is arranged on an upstream side of the nip portion and on a downstream side of the second suspension roller with respect to a rotating direction of the second belt.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

[Image Forming Apparatus]

Figure 6:
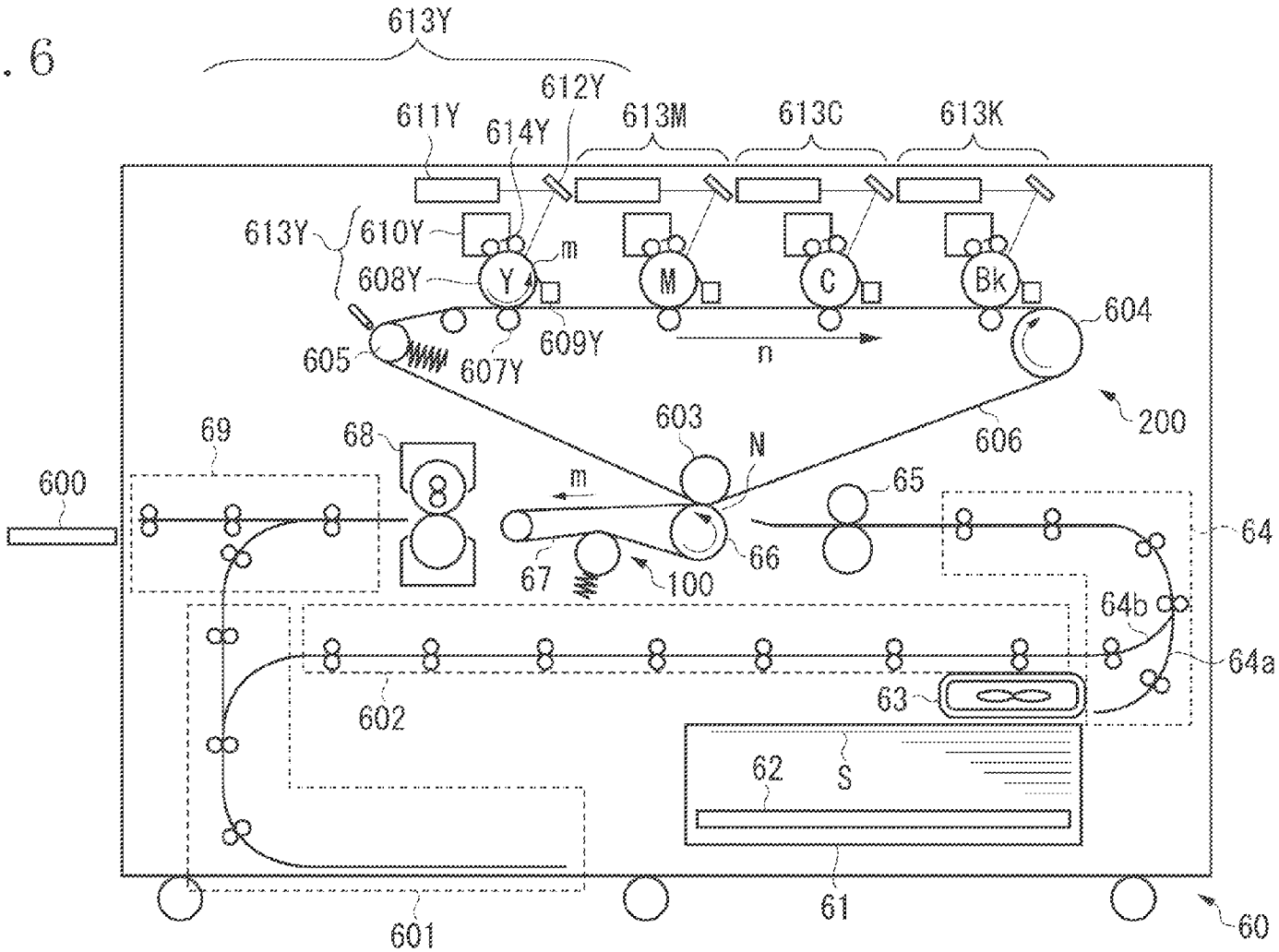
FIG. 6 is a sectional view of an image forming apparatus according to the first exemplary embodiment of the present invention.

An image forming apparatus according to a first exemplary embodiment of the present invention will be described with reference to the sectional view of FIG. 6. An image forming apparatus 60 illustrated in FIG. 6 is a full color image forming apparatus employing an electrophotographic method. The image forming apparatus 60 is an intermediate transfer tandem type image forming apparatus in which image forming units of four colors are arranged side by side on an intermediate transfer belt.

The image forming apparatus according to the present invention will be described. First, an operation of the image forming apparatus will be described with reference to FIG. 6. The image forming apparatus 60 illustrated in FIG. 6 is a color image forming apparatus employing electrophotography. FIG. 6 is a sectional view of the image forming apparatus 60 referred to as a intermediate transfer tandem type, in which the image forming units of four colors are arranged side by side on the intermediate transfer belt.

[Recording Material Conveyance Process]

Recording materials S are accommodated in a recording material accommodation unit 61 while stacked on a lift-up apparatus 62, and are fed by a sheet feeding unit 63 in synchronism with image formation. The sheet feeding unit 63 is one configured to effect separation and attraction by utilizing air. The recording material S sent out from the sheet feeding unit 63 passes through a conveyance path 64*a* of a conveyance unit 64, and is conveyed to a registration apparatus 65. After undergoing skew feed correction and timing correction in the registration apparatus 65, the recording material S is transmitted to a secondary transfer unit. The secondary transfer unit is a secondary transfer nip unit formed by a secondary transfer inner roller 603 and a secondary transfer outer roller 66, which are facing each other. The secondary transfer unit applies a predetermined pressing force and an electrostatic load bias to the recording material S to transfer a toner on an intermediate transfer belt thereto.

[Image Forming Process]

The conveyance process of the recording material S to the secondary transfer unit is performed as described above. An image forming process, which is performed up to the secondary transfer unit with a similar timing to the conveyance process, will be described below. In the present exemplary embodiment, there are arranged an image forming unit 613Y configured to perform image formation with an yellow toner, an image forming unit 613M configured to perform image formation with a magenta toner, an image forming unit 613C configured to perform image formation with a cyan toner, and an image forming unit 613Bk configured to perform image formation with a black toner.

Apart from the colors of the toners, the image forming units 613 are of the same configuration, thus, as a representative, the image forming unit 613Y will be described. The image forming unit 613Y mainly includes a photosensitive member 608Y, a charging device 614Y, an exposure device 611Y, a developing apparatus 610Y, a primary transfer roller 607Y, a photosensitive member cleaner 609Y, or the like. The photosensitive member 608Y is uniformly charged on its surface by the charging device 614Y in advance and rotates in the direction of an arrow m in the drawing. The exposure device 611Y is driven based an image information signal is transmitted to the photosensitive member 608Y, and a latent image is formed via a diffraction unit 612 or the like as appropriate.

An electrostatic latent image formed on the photosensitive member 608 is visualized on the photosensitive member as a toner image through toner development by the developing apparatus 610Y. Then, a predetermined pressing force and electrostatic load bias are applied by the primary transfer roller 607Y, and the toner image is transferred onto an intermediate transfer belt 606, which is a belt member. A transfer residual toner remaining on the photosensitive member 608 is then collected by the photosensitive member cleaner 609Y, and the photosensitive member is made ready for the next image formation. The above-described image forming operation is executed in each image forming unit.

Next, the intermediate transfer belt 606 will be described. The intermediate transfer belt 606 is suspended between rollers such as a driving roller 604, a tension roller 605, and a secondary transfer inner roller 603, and is rotated in the direction indicated by an arrow n in the drawing. The above-described image forming process in each color, conducted in parallel by the image forming units 613 of the four colors Y, M, C, and Bk, are performed at a timing such that a toner image in a color is superimposed on another toner image in a different color which is primarily transmitted onto the intermediate transfer belt on the upstream side. As a result, a full color toner image is finally formed on the intermediate transfer belt 606, and is conveyed to a secondary transfer unit.

[Processes from the Secondary Transfer Onward]

As described above, through the conveyance process of the recording material S and the image forming process, a full color toner image is secondarily transferred onto the recording material S at the secondary transfer unit. Then, the recording material S is conveyed to a fixing apparatus 68 by a pre-fixing conveyance unit 67.

In the present exemplary embodiment, the secondary transfer unit N is formed by the intermediate transfer belt 606 serving as a first belt and a transfer belt 67 serving as a second belt conveying the recording material. Further, the secondary transfer unit N is formed by the secondary transfer inner roller 603 and the secondary transfer outer roller 66 via the intermediate transfer belt 606 and the transfer belt 67. Through the rotation of the transfer belt 67 in the direction of the arrow m, the recording material S on the transfer belt is conveyed to the fixing apparatus 68. At the fixing apparatus 68, a predetermined pressing force from facing rollers, belts or the like and a heating effect generally from a heat source such as a heater are applied to the recording material S to melt and fix the toner image to the recording material S.

A path of the recording material S with the fixed image thus obtained is selected by a branching conveyance apparatus 69 between discharge onto a discharge tray 600 and conveyance to a reverse conveyance apparatus 601, of which the latter is selected when two-sided image forming is required. In the case where two-sided image forming is required, the leading and trailing edges of the recording material S conveyed to the reverse conveyance apparatus 601 are changed by a switch back operation, then the recording materials S is conveyed to a two-sided conveyance apparatus 602. Then, in synchronism with the recording material S for the subsequent job conveyed from the sheet feeding apparatus 61, the foregoing reversed recording material S is conveyed so as to be joined from a re-feeding path 64*b* of the conveyance unit 64 and is similarly transmitted to the secondary transfer unit. Regarding the image forming process performed on the rear surface (second surface), it is the same as the above-described process performed on the front surface (first surface), so that a description thereof will be omitted.

[Details on the Belt Unit Portion]

Figure 1:
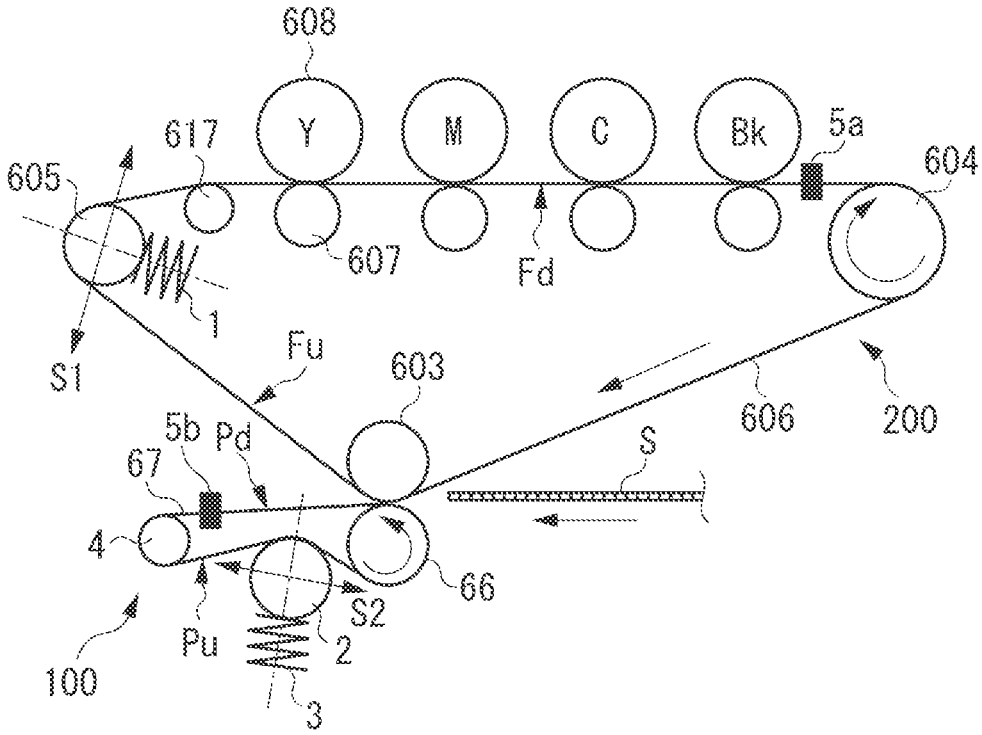
FIG. 1 is a sectional view of a belt member according to a first exemplary embodiment of the present invention.

FIG. 1 exclusively illustrates the intermediate transfer belt unit 200, the transfer belt unit 100, and the portions around the same.

In the intermediate transfer belt unit 200, a steering roller 605, which is the first steering roller, is arranged on the upstream side of the primary transfer surface facing to the image forming unit, and a driving roller 604 is arranged on the downstream side thereof, with respect to the rotating direction of the intermediate transfer 606. Further, there are provided therebetween the secondary transfer inner roller 603 and a suspension roller 617 for suppressing fluttering of the first transfer surface as a result of steering. The steering roller 605 also serves as a tension roller for applying a predetermined tension to the intermediate transfer belt 606 by a pressing spring 1. In the present exemplary embodiment, the surface of the belt suspended between the steering roller 605 and the secondary transfer roller 603 is served as the traction surface for the steering roller in the intermediate transfer belt unit 200. The secondary transfer roller 603 is a first suspension roller situated on the upstream side of the steering roller 605 in the rotating direction of the intermediate transfer belt 606

The steering roller 605 can change the alignment in the direction of an arrow S1 based on a signal from an edge detection sensor 5*a* configured to detect an edge position of the intermediate transfer belt, which is described in detail below.

In the transfer belt unit 100, there are arranged the secondary transfer outer roller 66 also serving as a driving roller and the secondary transfer belt 67 suspended on a separation roller 4 which is of a smaller diameter than the secondary transfer outer roller 66. Further, a steering roller 2 which is a second steering roller of an external suspension type is in contact with the outer peripheral surface of the secondary transfer belt 67, and is arranged on the non-transfer surface side. The steering roller 2 also serves as a tension roller configured to apply a predetermined tension to the secondary transfer belt 67 by a pressing spring 3.

In the present exemplary embodiment, the surface of the belt suspended between the steering roller 2 and the separation roller 4 is served as the traction surface for the steering roller in the transfer belt unit 100. The separation roller 4 is a second suspension roller situated on the upstream side of the steering roller 2 in the rotating direction of the transfer belt 67.

The steering roller 2 can change the alignment in the direction of an arrow S2 based on a signal from an edge detection sensor 5*b* configured to detect an edge position of the secondary transfer belt.

Both the intermediate transfer belt 606 and the secondary transfer belt 67 are single-layer or multi-layer belts each having, at least a resin belt formed of polyimide or the like as a base layer. In the image forming apparatus according to the present exemplary embodiment, the intermediate transfer belt unit 200 and the transfer belt unit 100 included in the above-described suspension layout, are held in press contact with each other at the secondary transfer portion.

[Mechanism and Control of the Steering Roller Unit]

In the present exemplary embodiment, the intermediate transfer belt unit 200 and the transfer belt unit 100 are respectively equipped with steering rollers of basically the same mechanism although the one is of an internal suspension type and the other is of an external suspension type. In the present exemplary embodiment, by inclining the steering rollers, the belt position in the width direction, which is orthogonal to the belt moving direction, is adjusted. In the following, the mechanism and control of the intermediate transfer belt will be described by way of example.

Figure 2A:
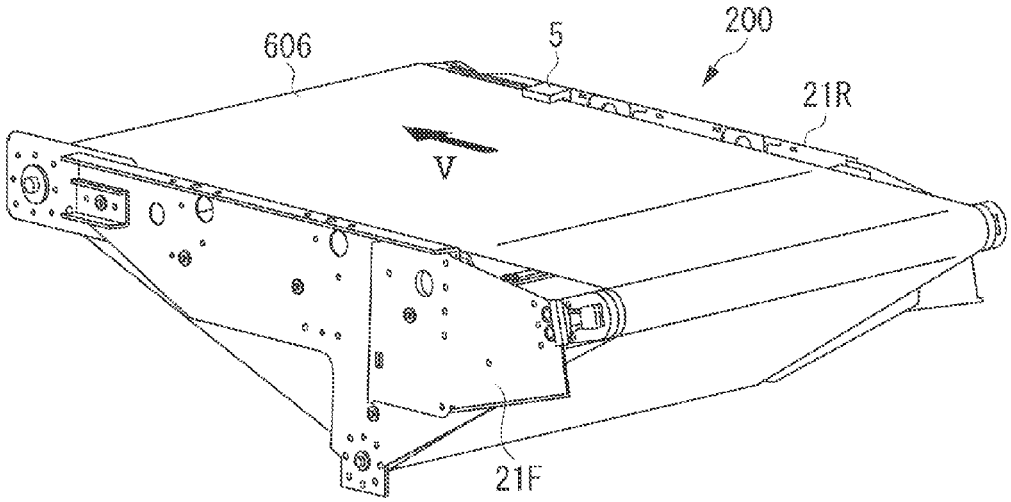
FIGS. 2A and 2B are perspective views illustrating an intermediate transfer belt unit.
Figure 2B:
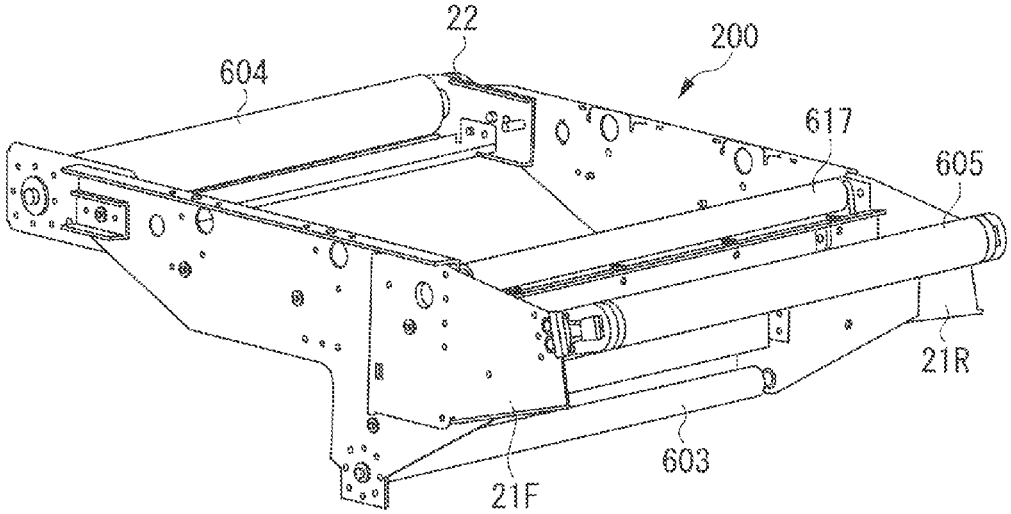
Figure 3:
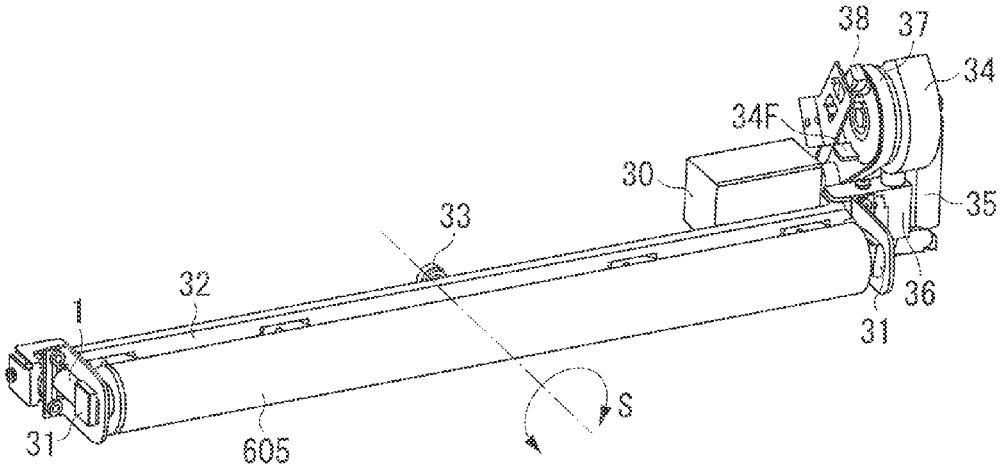
FIG. 3 is a first perspective view illustrating the mechanism of a steering roller unit according to the present invention.
Figure 4:
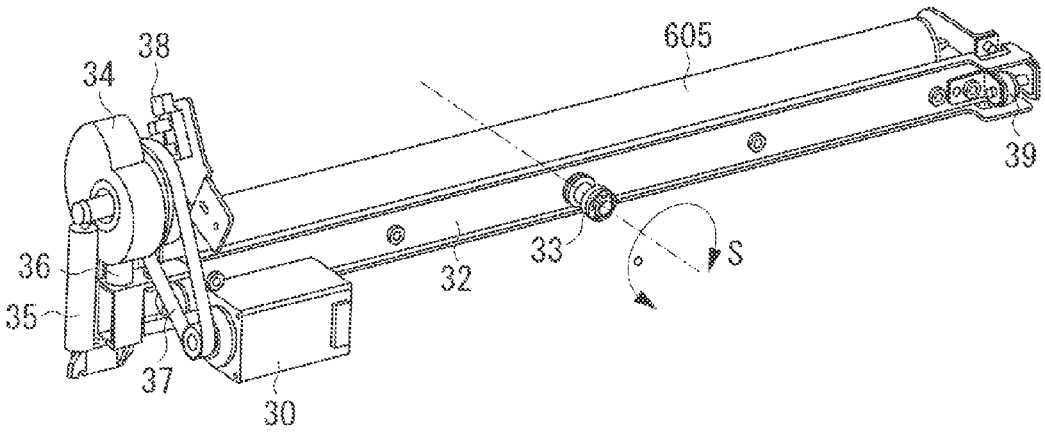
FIG. 4 is a second perspective view illustrating the mechanism of the steering roller unit according to the present invention.

FIGS. 2A and 2B are perspective views illustrating the intermediate transfer belt unit 200. FIG. 2A illustrates the state in which the intermediate transfer belt 606 is suspended, and FIG. 2B illustrates the state in which the intermediate transfer belt 606 has been removed. The steering roller 605 is one of the suspension rollers extending between a front sideplate 21F and a rear sideplate 21R which constitute a unit casing. FIGS. 3 and 4 (of which FIG. 4 illustrates the same thing as that of FIG. 3 as seen from the opposite side) are perspective views illustrating in detail a rotating portion actually effecting steering and the driving portion for the same.

The steering roller 605 is supported so as to be capable of being driven to rotate by bearing members 31 on both ends. The bearing members 31 are urged by the pressing spring 1. The bearing members 31 are mounted to a holder member 32 holding the steering roller 605. The holder member 32 has a rotation shaft 33 fixed in position at the center in the axial direction of the roller.

In the state of FIGS. 2A and 2B, the rotation shaft 33 is borne by a stay member (not illustrated) provided between the front side plate 21F and the rear side plate 21R, and the steering roller 605 is rotatable in the direction of an arrow S (See FIGS. 3 and 4) together with the holder member 32. In this regard, a smooth rotational movement is effected due to guide rollers 39 (which are provided at both ends although only one of them is visible in FIG. 4) provided on the back surface of the holder member 32.

Next, the driving unit configured to change the axial alignment of the steering roller 605 by a predetermined amount will be described. A follower 36 is fixed to one end of the holder member 32. A steering cam 34 is supported so as to be rotatable around a shaft fixed to the casing of the intermediate transfer belt unit, and a tension spring 35 is stretched between the shaft end and a portion of the follower where the spring to be hooked. Due to this configuration, the holder member 32 and the steering roller 605 are constantly urged toward the position where the follower 36 and the steering cam 34 abut, and the axial alignment is determined.

The steering cam 34 has a pulley portion coaxially with the cam portion, and a driving force is transmitted by a timing belt 37 from a driving pulley of a motor 30 fixed to the casing. A home position flag 34F is provided on a pulley portion side surface of the steering cam 34, and home position detection is effected by a photo interrupter, so that it is possible to grasp the position where the axial alignment of the steering roller 605 is neutral. The steering motor 30 may be a stepping motor, and is pulse-driven by an amount corresponding to the requisite cam phase change.

Figure 15:
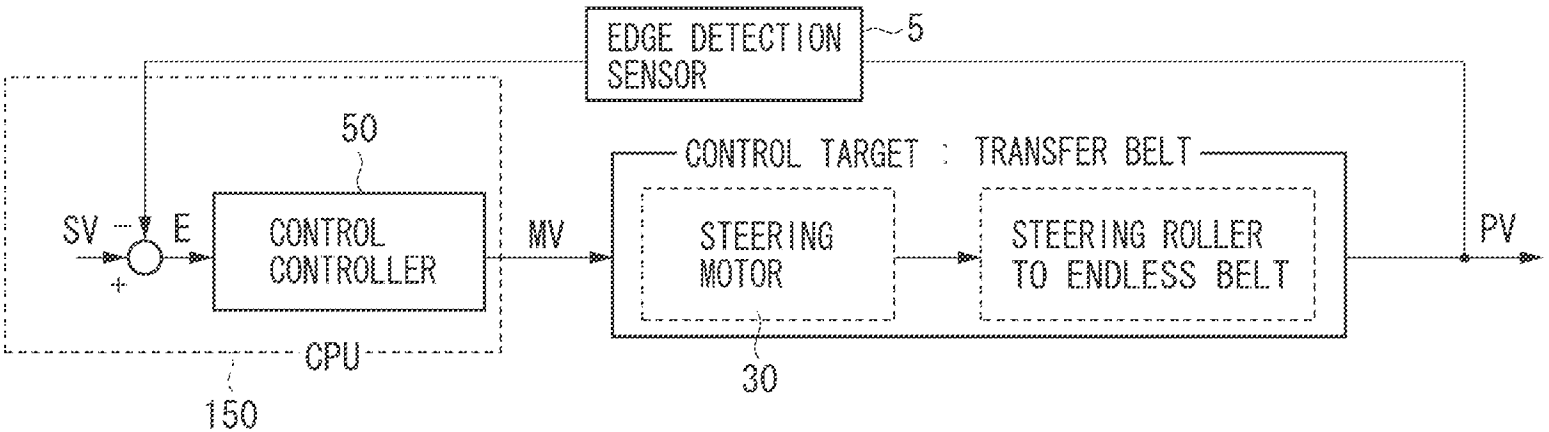
FIG. 15 is a block diagram illustrating a steering control operation.
Figure 16:
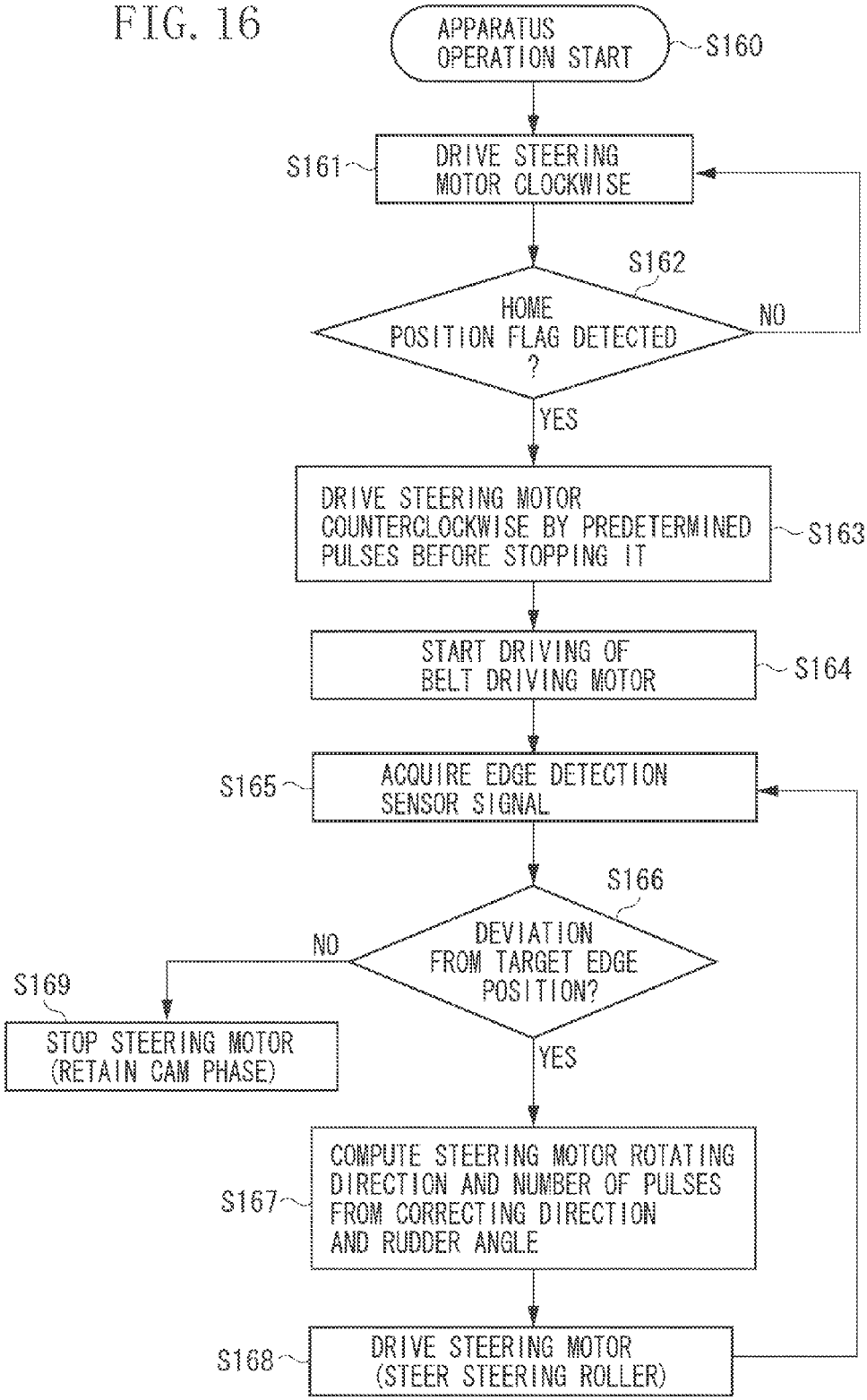
FIG. 16 is a flowchart illustrating the operation of a central processing unit (CPU) in the steering control operation.

Regarding the steering control operations, the intermediate transfer belt unit 200 and the transfer belt unit 100 are basically the same. FIG. 15 is a control block diagram for the steering control, and FIG. 16 is a flowchart illustrating a CPU processing. As can be seen from FIG. 15, a deviation E of a value PV (an actual belt edge position) detected by an edge detection sensor 5 from a target belt edge position SV is calculated, and there is conducted a feedback control using the CPU 150 including a control controller 50 configured to compute a command value MV based on the deviation E and the steering motor 30 driven in accordance with the command value MV, in the control block diagram itself, there is adopted a generally well-known technique.

As illustrated in FIG. 16, in control step S160, if an operation of the image forming apparatus is started, then in control steps S161 and S162, the steering motor 30 is driven to the clockwise direction by receiving inputs until the home position flag is detected. If the home position flag is detected (YES in control step S162), in control step S163, the steering motor is driven to rotate to the reverse direction, i.e., the counterclockwise direction, by a predetermined number of pulses, and then the steering motor is stopped. The predetermined number of pulses corresponds to the phase difference between the home position flag and a cam profile central portion, and the position where control step S163 has been completed is defined as the neutral position for the steering roller 605. The cam profile is formed such that, using the neutral position as a starting point, the axial alignment can be displaced by the same amount positively and negatively.

In control step S164, when the neutral position is obtained, the driving rollers 604 and 66 are started to drive. In control step S165, a signal from the edge detection sensor 5 is acquired. In control step S166, the deviation between the acquired signal and the predetermined target edge position is calculated. When there is a deviation (YES in control step S166), then in control step S167, the rotating direction of the steering motor 30 and the input pulse number are calculated from the correcting direction and an requisite rudder angle. In control step S168, the steering motor is driven.

As a result, the edge position of the endless belt member is displaced, and the acquirement of the signal from the edge detection sensor 5 and the calculation of the deviation from the target edge position are repeatedly performed. When there is no deviation (NO in control step S166), in control step S169, it is determined that the belt deviation has been corrected, and the steering motor 30 is stopped, thus the phase of the steering cam 34 is retained.

[Mutual Relationship Between Steering Control Operations]

Referring to FIG. 1, an influence of the steering control operations of the intermediate transfer belt unit 200 and the transfer belt unit 100 in the present exemplary embodiment will be described. From the suspension layout as described above, in the intermediate transfer belt 200, a primary transfer surface Fd which is suspended between the driving roller 604 and the suspension roller 617 is served as the traction surface pulled by the driving roller 604. The suspension roller 617 is situated on the upstream side of the driving roller 604 in the rotating direction of the intermediate transfer belt 606. The axial alignment of the driving roller is constant, so that it is not easily affected by the steering control operation. In other words, this configuration is advantageous from the viewpoint of the positional deviation (color misregistration) related to the superimposition of the four colors of Y, M, C, and Bk.

Figure 14:
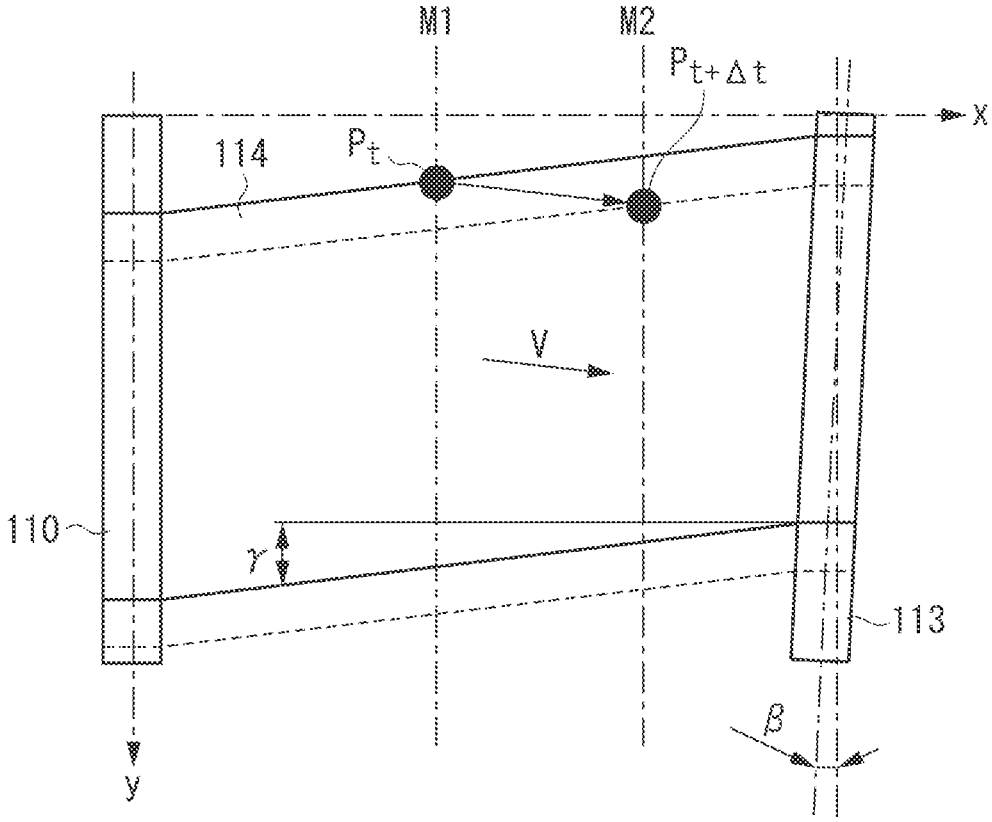
FIG. 14 is a second plan view illustrating a movement of the mass point on the traction surface.

On the other hand, a suspension surface Fu including the secondary transfer portion, which is suspended between the steering roller 605 and the secondary transfer roller 603, is served as the traction surface pulled by the steering roller 605. The secondary transfer roller 603 is situated on the upstream side of the steering roller 605 in the rotating direction of the intermediate transfer belt 606 Thus, the phenomenon in which a mass point is displaced in the thrust direction on the traction surface as described with reference to FIG. 14, is conspicuous.

On the other hand, in the transfer belt unit 100, a secondary transfer surface Pd, which is suspended between the separation roller 4 and the secondary transfer outer roller 66, is served as the traction surface pulled by the separation roller 4. The secondary transfer outer roller 66 is situated on the upstream side of the separation roller 4 in the rotating direction of the transfer belt The axial alignment of the separation roller is constant, so that it is not easily affected by the steering control operation. More specifically, in the secondary transfer portion, the displacement of a mass point in the thrust direction as described with reference to FIG. 14 does not easily occur.

On the other hand, a suspension surface Pu on the opposite side, which is suspended between the steering roller 2 and the separation roller 4, is served as the traction surface pulled by the steering roller 2. The separation roller 4 is situated on the upstream side of the steering roller 2 in the rotating direction of the transfer belt. Thus, the displacement of the mass point in the thrust direction as a result of the steering control operation is conspicuous.

However, the traction surface of the intermediate transfer belt 606 and the traction surface of the transfer belt 67 are not in contact with each other. Thus, even in a configuration in which the intermediate transfer belt 606 and the transfer belt 67 are respectively controlled the steering, it is possible to reduce the influence of the traction surface due to the steering control operation of the one belt on the other belt.

Figure 5:
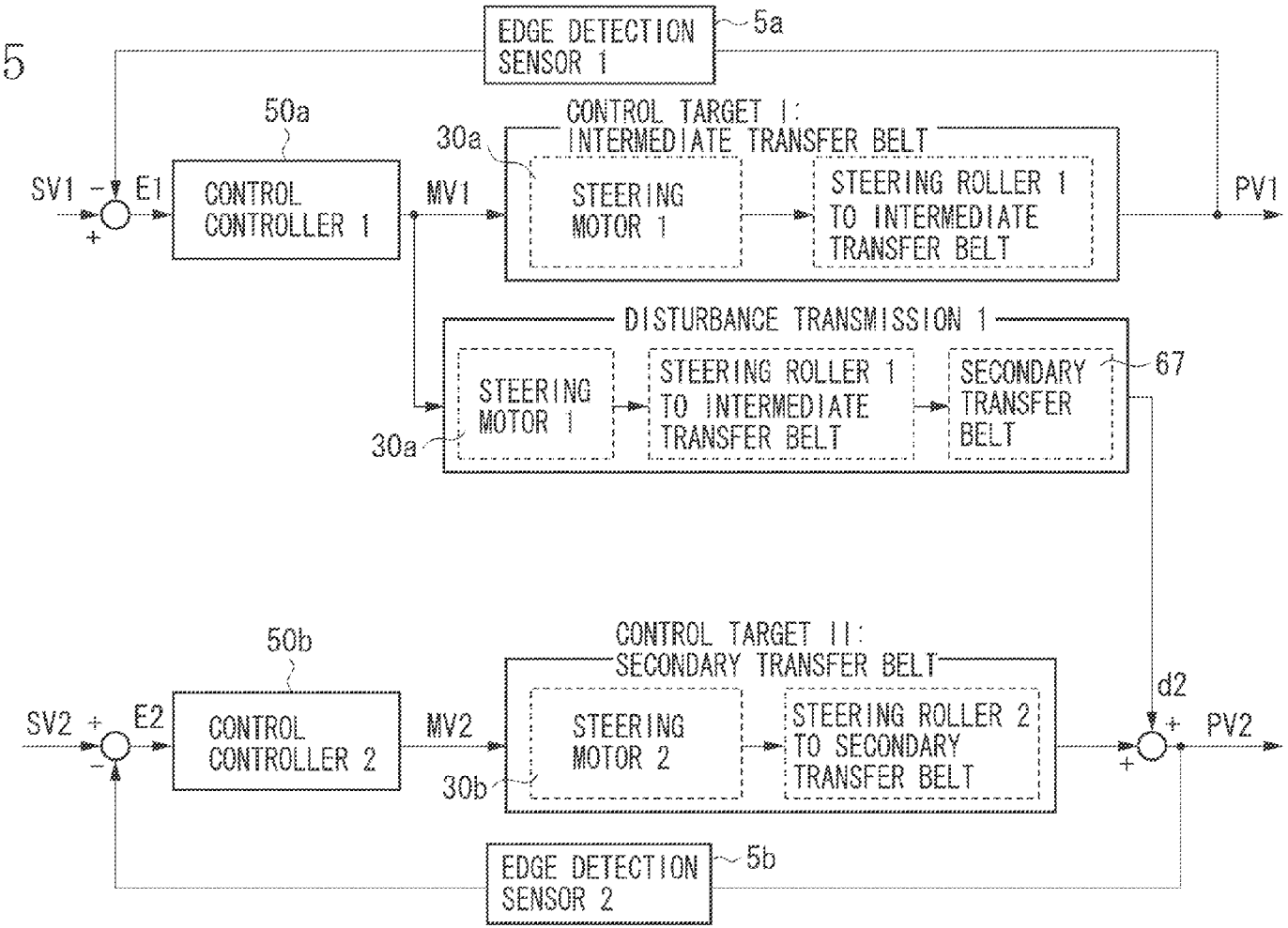
FIG. 5 is a control block diagram for the first exemplary embodiment of the present invention.

FIG. 5 is a block diagram illustrating the mutual relationship between the belt units in the steering control operations. The upper part indicates the control block for the steering control operation of the intermediate transfer belt unit 200, and the lower part indicates the control block for the steering control operation of the transfer belt unit 100. Regarding instructions issued by the CPU including the control controller, the flowchart of FIG. 16, described above, is to be referred to.

The present exemplary embodiment aims to achieve an improvement in terms of color misregistration, which is an issue peculiar to a full color image forming apparatus, from this point of view, the application of an external force in the thrust direction to the second transfer belt 67 from the intermediate transfer belt 606 at the secondary transfer portion is permitted. In other words, in this system, a command value MV1 from the control controller 1 (50*a*) in FIG. 5 controls the edge position of the intermediate transfer belt, and, at the same time, the command value MV1 serves as a disturbance d2 in controlling the edge position of the secondary transfer belt via disturbance transmission I.

Figure 17:
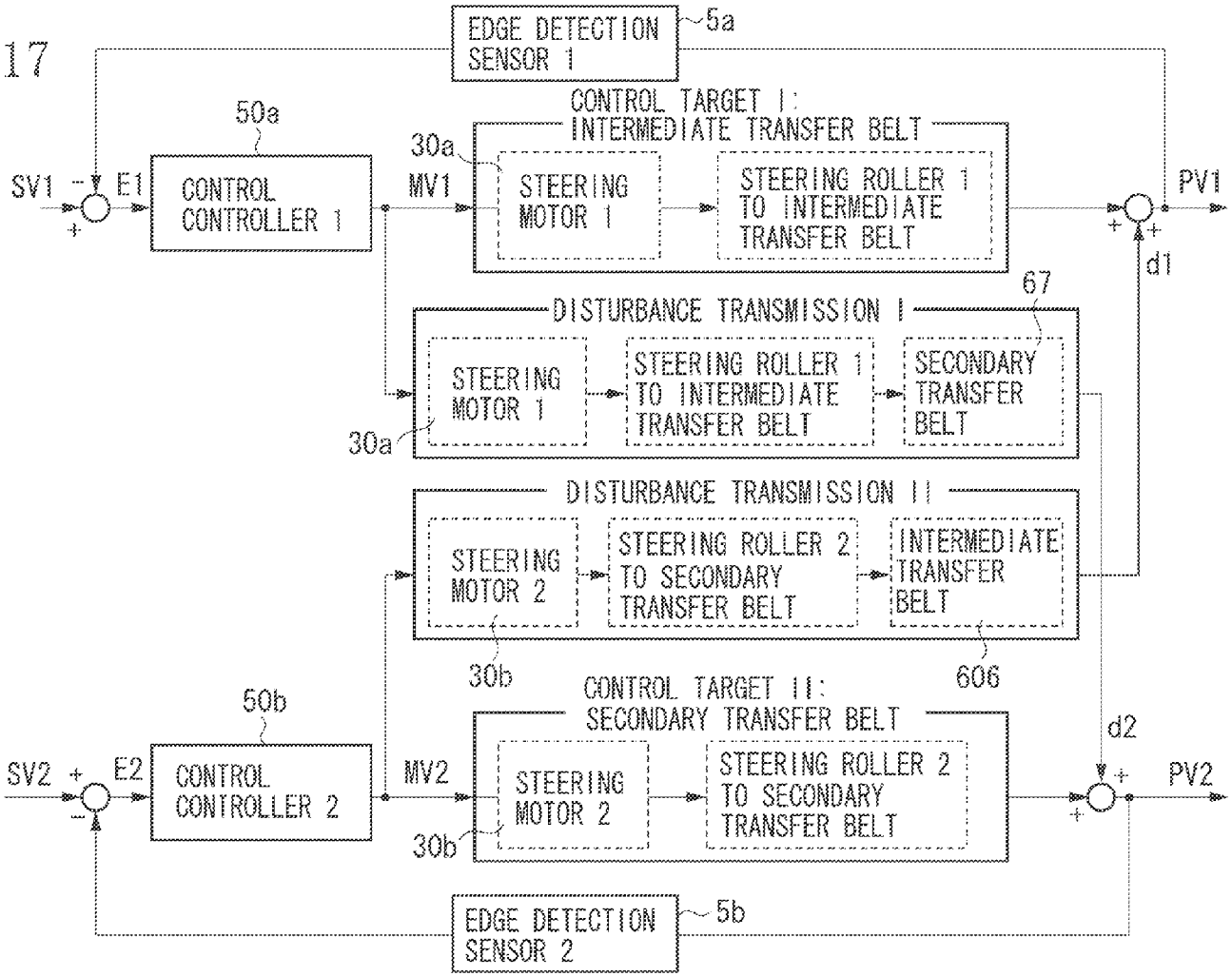
FIG. 17 is a block diagram illustrating how steering control operations interfere with each other.
Figure 18A:
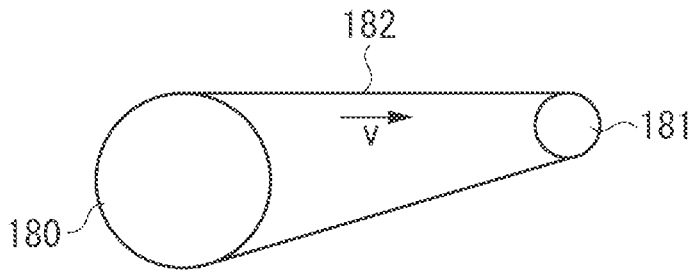
FIGS. 18A and 18B are sectional views illustrating a secondary transfer belt.
Figure 18B:
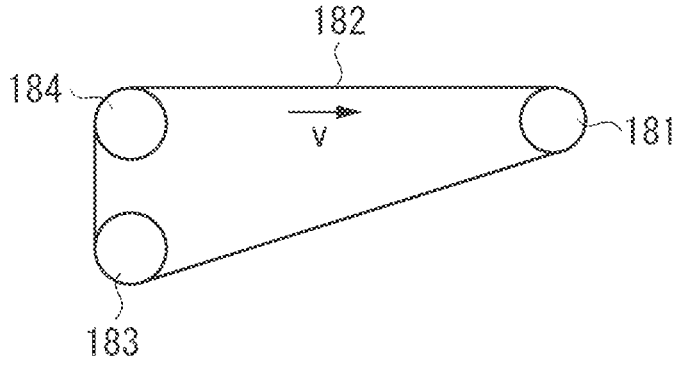

However, no external force in the thrust direction is applied to the intermediate transfer belt 606 from the secondary transfer belt 67, so that the disturbance input is restricted to one direction, making it possible to avoid a system in which the influences of two steering control operations interfere with each other as illustrated in FIG. 17. Therefore, the present exemplary embodiment, while providing an advantage on image quality issues, such as color misregistration, can improve the following property of target value of the control controller 1 (50*a*) without adopting any complicated configuration, and realize an image formation including an intermediate transfer belt and a secondary transfer belt superior in media adaptability.

Although in the present exemplary embodiment described above an electrophotographic type apparatus using toners is adopted, the image forming units thereof may be of other types such as an ink jet type and an offset printing type. Further, instead of an intermediate transfer belt, it is also possible to use a photosensitive belt having a photosensitive member layer, performing image formation directly on the photosensitive belt by the image forming units.

Figure 7:
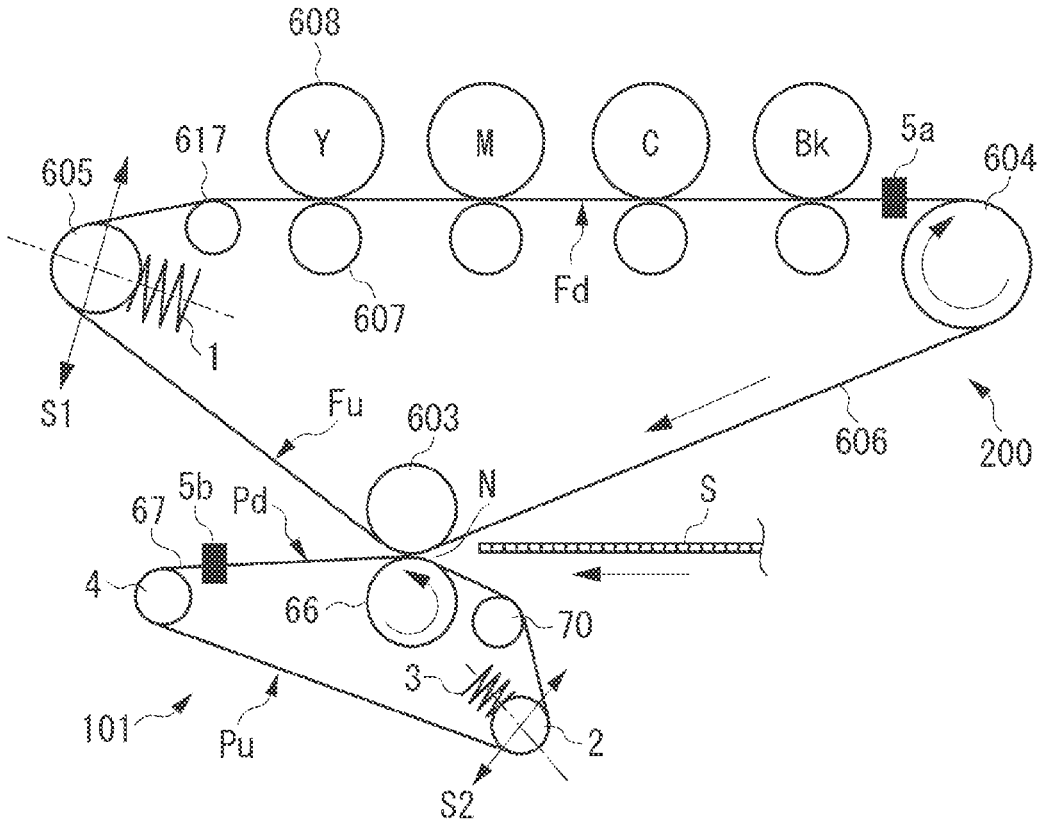
FIG. 7 is a sectional view of belt members according to a second exemplary embodiment of the present invention.

As illustrated in FIG. 7, in a second exemplary embodiment of the present invention, an internal suspension configuration there is adopted to a steering roller 2 included in a transfer belt unit 101. The configuration of the image forming apparatus according to the present exemplary embodiment is basically similar to that of the image forming apparatus 60 according to the first exemplary embodiment described with reference to FIG. 6, and only the suspension layout of the transfer belt unit is replaced by that of FIG. 7. Thus, the two exemplary embodiments employ the same conveyance process and the same image forming process, so a description thereof will be omitted, and the following description will center on the differences.

[Configuration of the Transfer Belt Unit]

The transfer belt unit 101 includes a secondary transfer belt 67, which includes a resin belt formed of polyimide or the like as a base layer, is suspended between the secondary transfer outer roller 66 also serving as a driving roller, the separation roller 4, the steering roller 2, and a suspension roller 70. The steering roller 2 also serves as a tension roller for applying a desired tension to the secondary transfer belt 67 by the pressing spring 3, and is configured to change the axial alignment in the direction of an arrow S2 in the drawing.

In controlling the axial alignment, there is adopted a method for driving a steering motor based on a signal from an edge detection sensor 5*b* configured to detect an edge position of the secondary transfer belt 67, the same mechanical and control configuration as that illustrated in FIGS. 3, 4, 15, and 16 is used. The suspension roller 70 is arranged for the purpose of reducing vertical fluctuation of the suspension surface receiving the recording material S when the steering roller 2 moves.

[Mutual Relationship Between Steering Control Operations]

As illustrated in FIG. 7, the traction surface pulled by the steering roller 2 is the suspension surface Pu suspended between the steering roller 2 and the separation roller 4 situated on the upstream side of the steering roller 2 in the rotating direction of the transfer belt 67. The suspension surface Pu is a surface not including the secondary transfer portion N formed by the secondary transfer inner roller 603 and the secondary transfer outer roller 66. Thus, even if a mass point on the suspension surface Pu is displaced in the thrust direction, no external force is applied to the intermediate transfer belt 606.

On the other hand, the suspension roller pulling the secondary transfer surface Pd including the secondary transfer portion N is the separation roller 4 whose axial alignment is constant, so that it is not easily influenced by the steering control operation of the secondary transfer belt 67. Regarding the intermediate transfer belt unit 200, the primary transfer surface Fd serves as the traction surface for the driving roller 604, and the secondary transfer surface Fu serves as the traction surface for the steering roller 605 so as to be advantageous in color misregistration as in the first exemplary embodiment.

As described above, the mutual relationship between the two steering control operations is as illustrated in the block diagram in FIG. 5 as in the first exemplary embodiment. In other words, the direction in which the disturbance accompanying the steering control operation is input is restricted to one direction, that is, from the intermediate transfer belt 606 to the secondary transfer belt 67, thus making it possible to avoid a system in which the influences of two steering control operations interfere with each other. Accordingly, while providing an advantage on image quality issues, such as color misregistration, the present exemplary embodiment can improve the following property of target value of the control controller 1 (50*a*) without adopting any complicated configuration, and realize an image formation including an intermediate transfer belt and a secondary transfer belt superior in media adaptability.

In this way, the present invention is not restricted to the layout referred to as the external suspension layout, in which the steering roller is arranged on the outer side of the endless belt member, but also allows to achieve the same effect with the internal suspension layout as in the present exemplary embodiment by adopting a configuration in which the traction surface pulled by the steering roller does not constitute the contact portion between endless belt members.

[Image Forming Apparatus]

Figure 8:
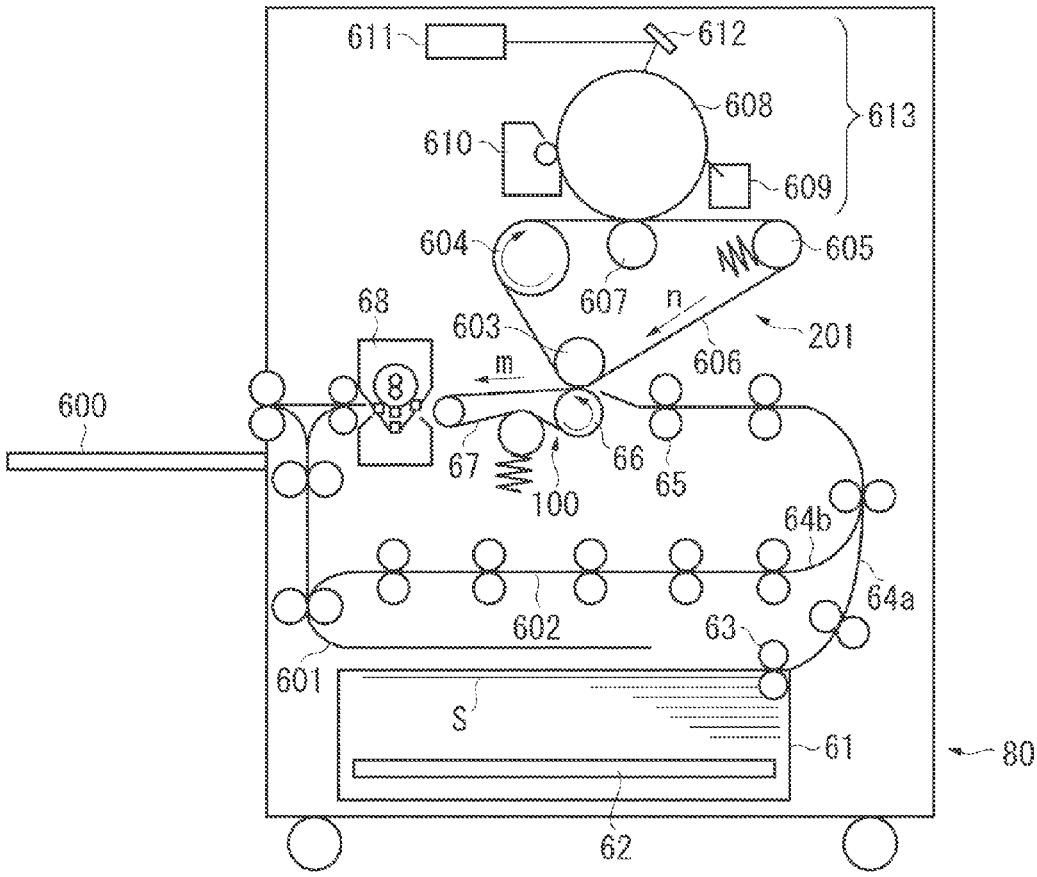
FIG. 8 is a sectional view of an image forming apparatus according to a third exemplary embodiment of the present invention.

An image forming apparatus according to a third exemplary embodiment of the present invention is an intermediate transfer type monochrome image forming apparatus as illustrated in the sectional view in FIG. 8. The conveyance process of the recording material S is similar to that in the image forming apparatus 60 illustrated in FIG. 6, so a description thereof will be omitted. An image forming apparatus 80 only includes a black (Bk) image forming unit 613, which mainly includes a photosensitive member 608, an exposure device 611, a developing apparatus 610, a primary transfer device 607, a photosensitive member cleaner 609, or the like. The image forming process is basically similar to that of the image forming apparatus 60 illustrated in FIG. 6, so a description thereof will be omitted.

In an intermediate transfer belt unit 201, the intermediate transfer belt 606 is suspended between the driving roller 604, the tension roller 605, and the secondary transfer inner roller 603, and is driven in the direction of an arrow n in the drawing, so that a toner image formed by the above-described image forming process is borne and conveyed to the secondary transfer portion.

In the transfer belt unit 100, the toner image is transferred onto the recording material S from the intermediate transfer belt 606. Further, the secondary transfer belt 67 attracts and retains the recording material S to deliver it to the fixing apparatus 68 on the downstream side. From the fixing process by the fixing apparatus 68 onward, the processes conducted are similar to those in the image forming apparatus 60 illustrated in FIG. 6, so a description thereof will be omitted.

[Details on the Belt Unit Portion]

Figure 9:
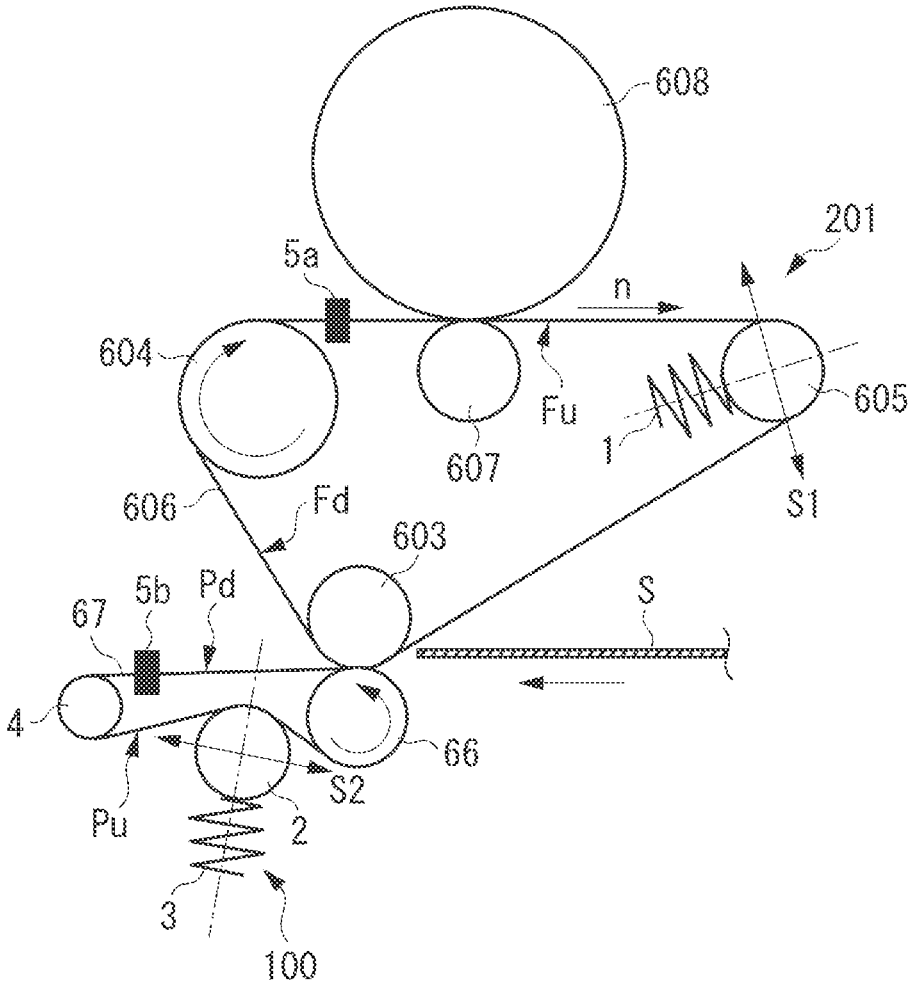
FIG. 9 is a sectional view of belt members according to the third exemplary embodiment of the present invention.

FIG. 9 exclusively illustrates the intermediate transfer belt unit 201, the transfer belt unit 100, and the peripheral portions thereof. The intermediate transfer belt unit 201 has the suspension layout in which the driving roller 604 is arranged on the upstream side of the primary transfer surface, the steering roller 605 is arranged on the downstream side thereof, and, further, the secondary transfer inner roller 603 is arranged therebetween. The steering roller 605 also serves as a tension roller for applying a predetermined tension to the intermediate transfer belt 606 by a pressing spring 1. The steering roller 605 can change the alignment in the direction of an arrow S1 based on a signal from the edge detection sensor 5*a* configured to detect the edge position of the intermediate transfer belt, which is described in detail below.

In the transfer belt unit 100, the secondary transfer belt 67 is suspended between the secondary transfer outer roller 66 also serving as a driving roller and the separation roller 4 below with a relatively small diameter, and the steering roller 2 of the external suspension type is arranged on the non-transfer surface side. The steering roller 2 also serves as a tension roller configured to apply a predetermined tension to the secondary transfer belt 67 by a pressing spring 3. The steering roller 2 can change the alignment in the direction of an arrow S2 based on a signal from an edge detection sensor 5*b* configured to detect an edge position of the secondary transfer belt.

Both the intermediate transfer belt 606 and the secondary transfer belt 67 are single-layer or multi-layer belts each having, at least a resin belt formed of polyimide or the like as a base layer. In the image forming apparatus according to the present exemplary embodiment, the intermediate transfer belt unit 201 and the transfer belt unit 100 included in the above-described suspension layout, are held in press contact with each other at the secondary transfer portion.

In the present exemplary embodiment, the intermediate transfer belt unit 201 and the transfer belt unit 100 are respectively equipped with steering rollers of basically the same mechanism as illustrated in FIGS. 3 and 4 although the one is of an internal suspension type and the other is of an external suspension type. The steering control operations on both the intermediate transfer belt unit 201 and the transfer belt unit 100 are conducted based on the control block diagram in FIG. 15 and the CPU flowchart in FIG. 16.

[Mutual Relationship Between Steering Control Operations]

Referring to FIG. 9, the influence of the steering control operations of the intermediate transfer belt unit 201 and the transfer belt unit 100 in the present exemplary embodiment will be described. Based on the suspension layout as described above, in the intermediate transfer belt 201, the primary transfer surface Fu suspended between the steering roller 605 and the suspension roller 604 serves as the traction surface pulled by the steering roller 605. The suspension roller 604 is situated on the upstream side of the steering roller 605 in the rotating direction of the intermediate transfer belt 606. Thus, the phenomenon in which a mass point is displaced in the thrust direction on the traction surface as described with reference to FIG. 14, is conspicuous. In the present exemplary embodiment, the secondary transfer surface Fd including another transfer portion serves as the traction surface pulled by the driving roller 604 whose axial alignment is constant.

On the other hand, in the transfer belt unit 100, the secondary transfer surface Pd suspended between the driving roller 66 and the separation roller 4 serves as the traction surface pulled by the separation roller 4 whose axial alignment is constant. The separation roller 4 is situated on the downstream side of the transfer belt 67 in the rotating direction of the transfer belt 67. Thus, in the secondary transfer portion, the displacement of the mass point in the thrust direction accompanying the steering control operation is not easily generated.

On the other hand, the suspension surface Pu on the opposite side, which is suspended between the steering roller 2 and the separation roller 4, is served as the traction surface pulled by the steering roller 2. The separation roller 4 is situated on the upstream side of the steering roller 2 in the rotating direction of the transfer belt. Thus, the displacement of the mass point in the thrust direction accompanying the steering control operation is conspicuous. However, since it is a suspension surface having no portion directly contacting with the intermediate transfer belt 606, the influence is very little.

Figure 10:
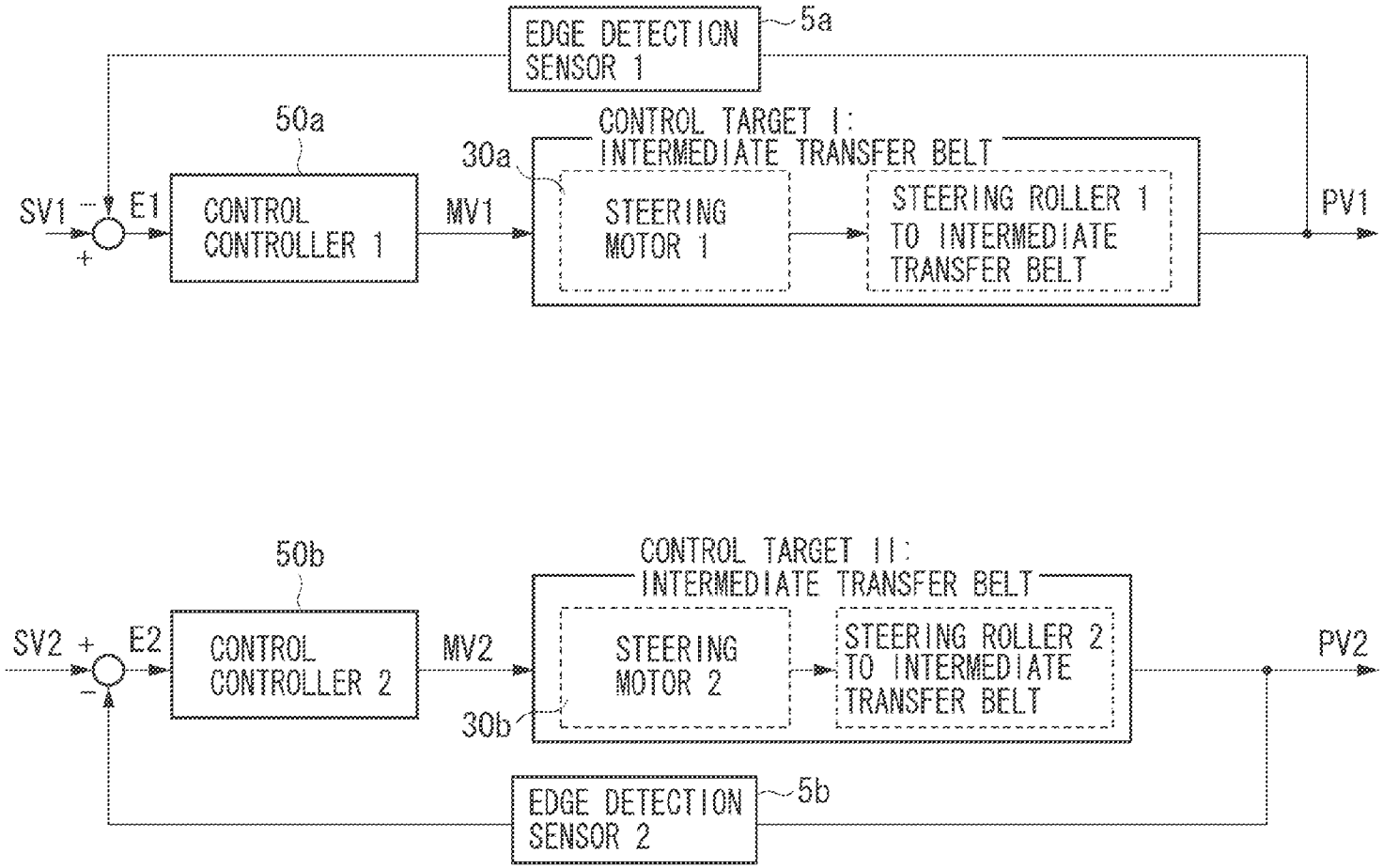
FIG. 10 is a control block diagram for the third exemplary embodiment of the present invention.
Figure 11:
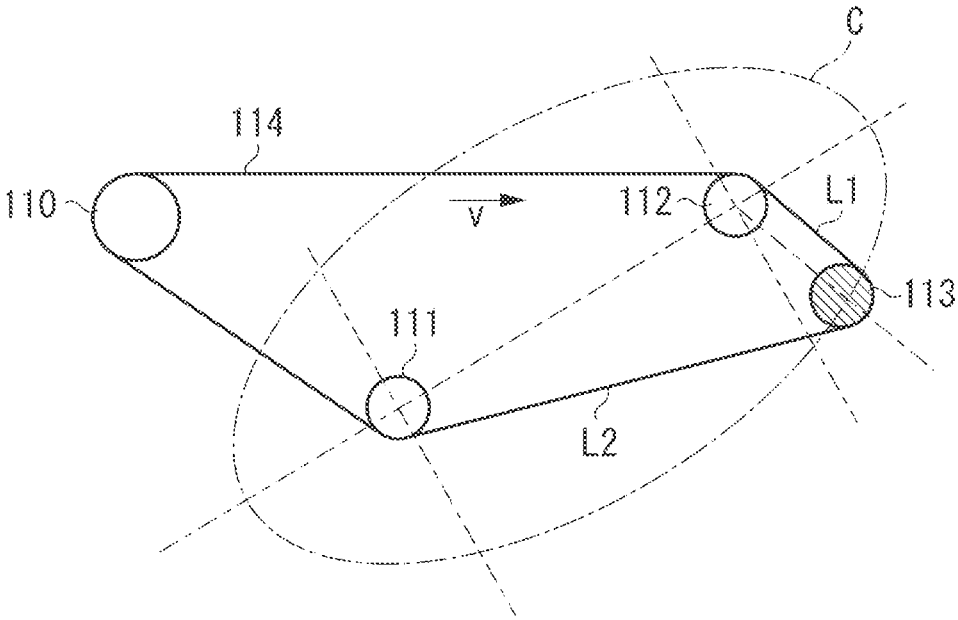
FIG. 11 is a sectional view illustrating an elliptical path in a suspension layout.
Figure 12:
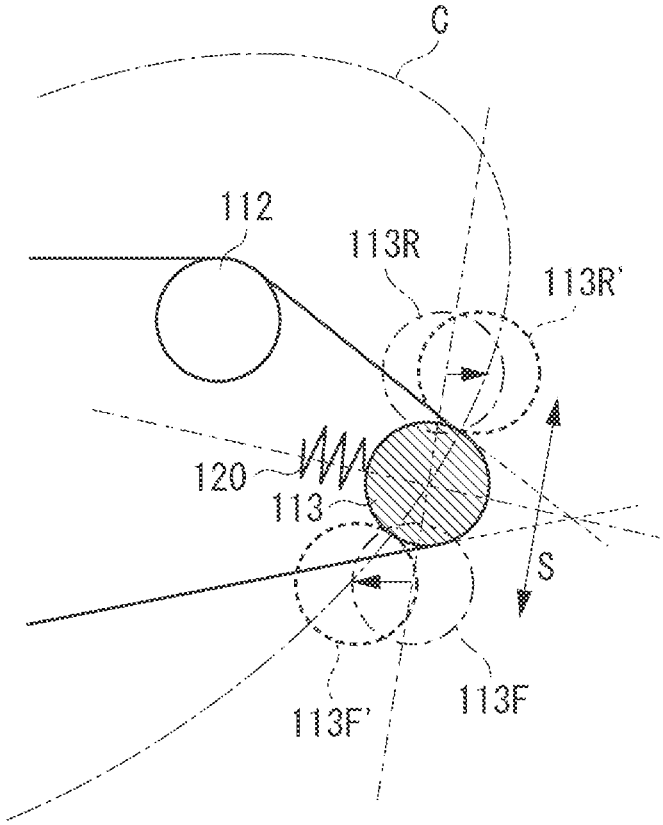
FIG. 12 is a sectional view illustrating an operation path of a steering roller.
Figure 13:
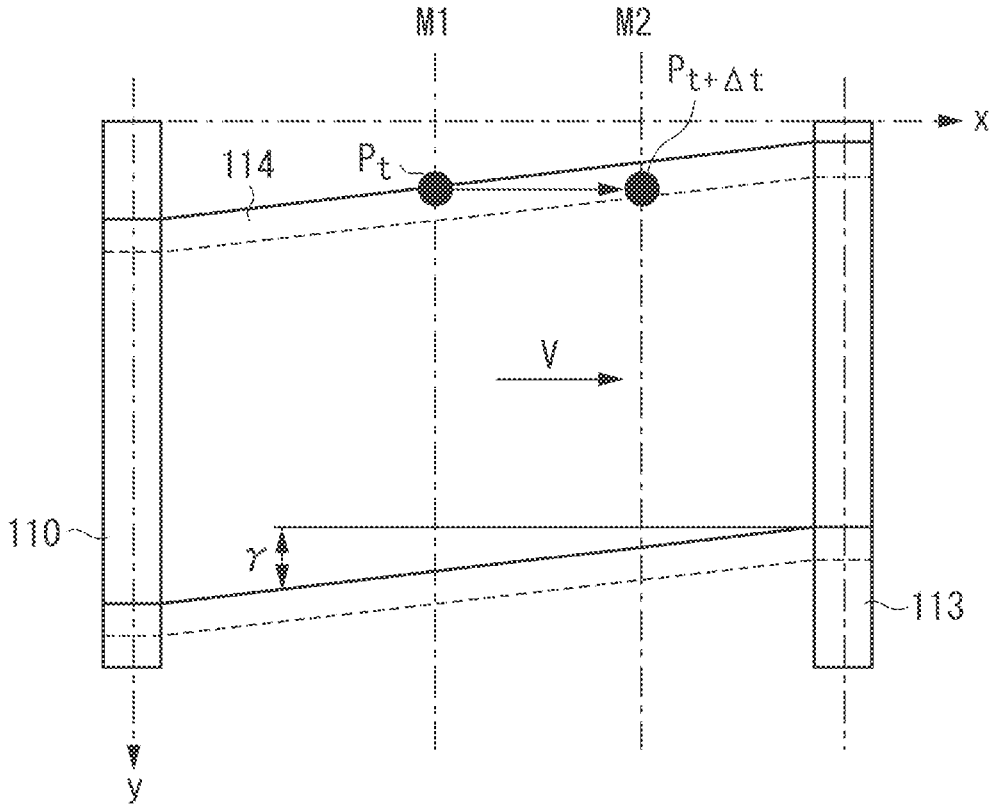
FIG. 13 is a first plan view illustrating a movement of a mass point on a traction surface.

FIG. 10 is a block diagram illustrating the mutual relationship between the steering control operations in the two belt units. The upper part indicates the control block for the steering control operation of the intermediate transfer belt unit 200, and the lower part indicates the control block for the steering control operation of the transfer belt unit 100. Regarding instructions issued by the CPU including the control controller, the flowchart of FIG. 16, described above, is to be referred to.

The image forming apparatus according to the present exemplary embodiment is a monochrome image forming apparatus, in which there is no need to take color misregistration into consideration, so that the apparatus permits the displacement of a mass point on the primary transfer surface in the thrust direction, and places priority on an advantage that no external force in the thrust direction is applied from the intermediate transfer belt 606 to the secondary transfer belt 67 in the secondary transfer portion. Similarly, no external force is applied from the secondary transfer belt 67 to the intermediate transfer belt 606. Thus, a command value MV1 from the control controller 1 (50*a*) and a command value MV2 from the control controller II (50*b*) respectively control the edge position of the intermediate transfer belt and that of the secondary transfer belt, thus constituting independent systems.

In other words, even in the case of a configuration in which two endless belt members have contact portions, it is possible to avoid a system in which, as illustrated in FIG. 17, the influences of two steering control operations interfere with each other. As a result, the present exemplary embodiment can improve the following property of target value of the control controller 1 (50*a*) and that of the control controller 2 (50*b*) without adopting any complicated configuration, and realize an image forming apparatus including an intermediate transfer belt and a secondary transfer belt superior in media adaptability.

Although in the present exemplary embodiment described above an electrophotographic type apparatus using toners is adopted, the image forming unit thereof may be of other types such as an ink jet type and an offset printing type. Further, instead of an intermediate transfer belt, it is also possible to use a photosensitive belt having a photosensitive member layer, performing image formation directly on the photosensitive belt by the image forming units.

In the intermediate transfer belt unit according to the first and second exemplary embodiments, a driving roller is provided on the downstream side of the image forming unit and a steering roller is provided on the upstream side thereof in the rotating direction of the intermediate transfer belt. However, the effect of the present invention can also be achieved by a configuration in which the positional relationship between the driving roller and the steering roller is changed.

As described above, according to the present invention, it is possible to reduce interfere with the belts by deviation control operations which are respectively conducted on belts held in contact with each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-248981 filed Nov. 5, 2010, which is hereby incorporated by reference herein in its entirety.

What is claimed is:

1. An image forming apparatus comprising:

a first belt rotatable and configured to bear a toner image;

an image forming unit configured to form a toner image on the first belt;

a second belt rotatable and configured to bear and convey a recording material;

a transfer unit configured to transfer the toner image formed on the first belt to the recording material borne by the second belt at a nip portion formed between the first belt and the second belt;

a first steering roller configured to adjust a position of the first belt in a width direction orthogonal to a moving direction of the first belt by inclining an axis;

a first supporting roller arranged adjacent to the first steering roller on an upstream side of the first steering roller in a rotation direction of the first belt and configured to suspend the first belt, the first steering roller and the first supporting roller forming a first traction surface including an area of the first belt suspended by the first steering roller and the first supporting roller and contact areas where the first steering roller and the first supporting roller are in contact with the first belt;

a second steering roller configured to adjust a position of the second belt in a width direction orthogonal to a moving direction of the second belt by inclining an axis, and configured to be an external supporting roller which forms a wrapping portion on an outer peripheral surface of the second belt; and a second supporting roller adjacent to the second steering roller on an upstream side of the second steering roller in a rotation direction of the second belt and configured to suspend the second belt, the second steering roller and the second supporting roller forming a second traction surface including an area of the second belt suspended by the second steering roller and the second supporting roller and contact areas where the second steering roller and the second supporting roller are in contact with the second belt, the first traction surface and the second traction surface not being in contact with each other.

2. The image forming apparatus according to claim 1, further comprising:

a detection unit configured to detect the position of the second belt in the width direction of the second belt; and a control unit configured to control an inclination of the second steering roller according to a detection result obtained by the detection unit.

3. The image forming apparatus according to claim 1, wherein the detection unit is configured to detect a position in a width direction of the belt surfaces forming the nip portion.

* * * * *